US006491004B2

(12) United States Patent
Rosskamp et al.

(10) Patent No.: US 6,491,004 B2
(45) Date of Patent: Dec. 10, 2002

(54) TWO-STROKE ENGINE

(75) Inventors: Heiko Rosskamp, Adelberg (DE); Michael Raffenberg, Fellbach (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/795,391

(22) Filed: Mar. 1, 2001

(65) Prior Publication Data

US 2001/0018901 A1 Sep. 6, 2001

(30) Foreign Application Priority Data

Mar. 1, 2000 (DE) ..... 100 09 621

(51) Int. Cl.[7] ..... F02B 33/04
(52) U.S. Cl. ..... 123/73 PP; 123/73 A
(58) Field of Search ..... 123/73 PP, 73 A, 123/73 R

(56) References Cited

U.S. PATENT DOCUMENTS 4,075,985 A * 2/1978 Iwai ..... 123/73 R
4,253,433 A * 3/1981 Blair ..... 123/73 B
5,983,846 A * 11/1999 Klopfer ..... 123/73 PP

FOREIGN PATENT DOCUMENTS

JP 5-33657 A * 2/1993 ..... 123/65 R

* cited by examiner

*Primary Examiner*—Gene Mancene
*Assistant Examiner*—Hyder Ali
(74) *Attorney, Agent, or Firm*—Walter Ottesen

(57) ABSTRACT

The invention relates to a two-stroke engine in a portable handheld work apparatus such as a motor chain saw. A combustion chamber (3) is formed in a cylinder (2) and is delimited by a piston (5). The piston (5) drives a crankshaft (7) via a connecting rod (6). The crankshaft is journalled in a crankcase (4). Air is supplied to the combustion chamber (3) via a first outlet-near transfer channel (15); whereas, the air/fuel mixture, which is needed for operation, flows in via a second outlet-remote transfer channel (12) from the crankcase (4). The constructive volume of the outlet-near transfer channel (15) is designed to be approximately 20% to 60% of the volumetric total air input of the engine (1) in order to achieve a complete charge of the combustion chamber while having low scavenging losses.

11 Claims, 2 Drawing Sheets

TWO-STROKE ENGINE

FIELD OF THE INVENTION

The invention relates to a two-stroke engine such as a drive engine in a portable handheld work apparatus including a motor chain saw, brushcutter, cutoff machine or the like.

BACKGROUND OF THE INVENTION

In known two-stroke engines, the air/fuel mixture needed for operation as well as clean air are supplied to the crankcase. The air flows in via channels close to the outlet. The entry openings of the transfer channels in the crankcase housing are arranged at different spatial locations in order to ensure that air or a low-fuel mixture enters the combustion chamber from the crankcase via the outlet-near transfer channel and that only a rich air/fuel mixture enters via the outlet-remote channel. This requires a complex channel arrangement and ensures that only air is supplied via the outlet-near channel at the start of the scavenging cycle. After a first introduction of air, a low-fuel mixture flows from the crankcase which escapes in considerable amounts via the outlet because of the outlet-near position of the transfer channels. This leads to an excellent charge of the combustion chamber but causes high hydrocarbon emissions in the exhaust gas because of the energy-rich scavenging losses which is unacceptable in view of a need to provide a high measure of environmental compatibility.

SUMMARY OF THE INVENTION

It is an object of the invention to provide a two-stroke engine which is improved so that, on the one hand, a complete charge of the combustion chamber with a mixture is ensured while, on the other hand, the mixture component, which escapes via the outlet, is held as small as possible.

The two-stroke engine of the invention includes a two-stroke engine in a portable handheld work apparatus. The two-stroke engine includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; a carburetor for supplying an air/fuel mixture and the carburetor having an intake channel; an inlet channel connected to the intake channel and leading to the crankcase for conducting the air/fuel mixture into the crankcase; the cylinder having a discharge outlet formed therein for conducting exhaust gases away from the combustion chamber; an outlet-near transfer channel connecting the crankcase to the combustion chamber; the outlet-near transfer channel having a first end defining a transfer window opening into the combustion chamber and a second end defining inflow opening open to the crankcase; an air channel connected to transfer channel between the first and second ends thereof for supplying an essentially fuel-free gas flow to the transfer channel; an outlet-remote transfer channel connecting the crankcase to the combustion chamber; the outlet-remote transfer channel having a first end defining a transfer window opening into the combustion chamber and a second end defining and inflow opening open to the crankcase; and, a sum of the constructive volumes of the outlet-near transfer channel between the transfer window and the inflow opening being approximately 20% to 60% of the volumetric total air input of the engine at rated engine speed.

The dimensions of the outlet-near transfer channels (that is, the constructive volumes between the transfer windows of the channels to the combustion chamber and their inflow openings from the crankcase) are so predetermined that the sum of these constructive volumes corresponds to approximately 20% to 60% of the total volumetric air input of the engine at rated engine speed rpm. In this way, a significant part of the total air of the engine is supplied as pure air via the outlet-near transfer channels. The mixture, which flows in from the crankcase, is designed to be correspondingly rich so that, after closing the outlet, the remaining air and the rich mixture define an air/fuel ratio which ensures a substantially complete combustion for a ready power development. The air quantity, which flows in via the outlet-near transfer windows corresponding to the provided constructive volume, provides an air curtain, which shields the outlet over the long duration of the scavenging cycle. This air curtain prevents an escape of the rich air/fuel mixture. Preferably, toward the end of the scavenging phase, the air/fuel mixture, which is inducted into the crankcase, can follow on also via the outlet-near transfer channels. For this reason, an advantageous change of the charge stratification results for the next combustion.

The outlet-near transfer channel is configured so as to be closed to the piston in order to easily make available the constructive volume of the outlet-near transfer channel. In this way, a wall is formed between a transfer channel and the cylinder bore and the thickness of the cylinder wall is between 2 mm and 6.5 mm. This thickness ensures an adequate shielding of the transfer channel from the hot interior of the cylinder whereby an excessive heating of the advanced air in the outlet-near transfer channel is prevented.

The outlet-remote transfer channels have the exclusive function of transfer. For this reason, these outlet-remote transfer channels are configured in a simple manner to be open toward the cylinder bore and this reduces manufacturing complexity. It is practical to also configure the outlet-remote transfer channels as closed toward the cylinder bore.

The two-stroke engine of the invention is advantageously so operated that approximately 30% to 70% (preferably approximately 35% to 45%) of the volumetric total air input of the engine is supplied via the outlet-near transfer channel at rated rpm of the engine. The volume design for the outlet-near transfer channels is provided in such a manner that the stratified charge, which is formed in the combustion chamber, is maintained over approximately 65% to 95% (preferably approximately 75%) of the duration of the scavenging operation.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
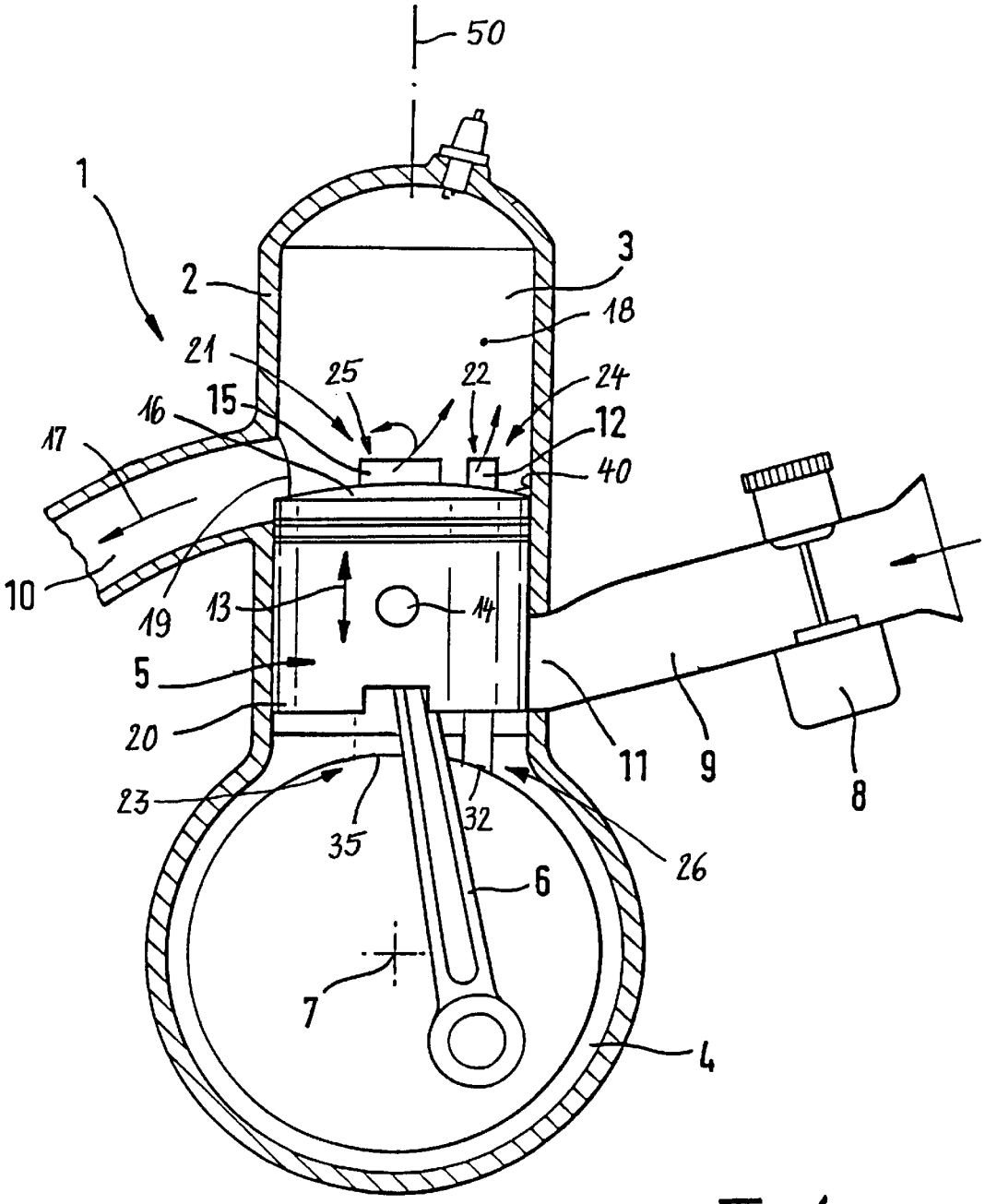
FIG. 1 is a schematic longitudinal section taken through a two-stroke engine with transfer channels lying on opposite sides of a symmetry plane of the cylinder; and, FIG. 2 is a schematic view of a cylinder of the two-stroke engine of FIG. 1.

The two-stroke engine 1 shown in FIG. 1 includes essentially a cylinder 2 and a piston 5 movable upwardly and downwardly in the direction of arrow 13. The piston 5 drives a crankshaft 7 via a connecting rod 6. The crankshaft 7 is mounted in a crankcase 4 and the connecting rod 6 is pivotally held on the piston 5 by a piston bolt 14.

A combustion chamber 3 is formed in the cylinder 2 and is delimited by the base 16 of the piston 5. The combustion chamber 3 has an outlet channel 10 via which the exhaust gases are discharged in a direction of arrow 17 after a work stroke. The outlet window 19 of outlet channel 10 is provided in the cylinder wall 18 and is controlled in dependence upon the stroke position of the piston 5. The air/fuel mixture, which is necessary for the operation of the two-stroke engine 1, is prepared in a carburetor 8 which communicates via an inlet channel 9 with the inlet 11 of the engine. The inlet 11 is controlled by the skirt 20 of the piston 5 as is the outlet window 19. The inlet 11 opens into the crankcase 4.

In the embodiment shown, the entire air/fuel mixture, which is supplied to the combustion chamber 3, is drawn in by suction via the crankcase 4 and is supplied to the combustion chamber 3 via transfer channels (12, 15). It can be advantageous to supply a portion of the mixture directly to the combustion chamber 3; however, it is preferable that the entire quantity of the mixture is drawn by suction via the crankcase 4.

In FIG. 1, the inlet 11 is closed by the piston skirt 20 in the region of bottom dead center of the piston 5; whereas, the outlet 19 is mostly open. It is practical to provide a membrane valve in view of the slot control of the inlet 11. This membrane valve opens when there is an underpressure in the crankcase 4.

Figure 2:
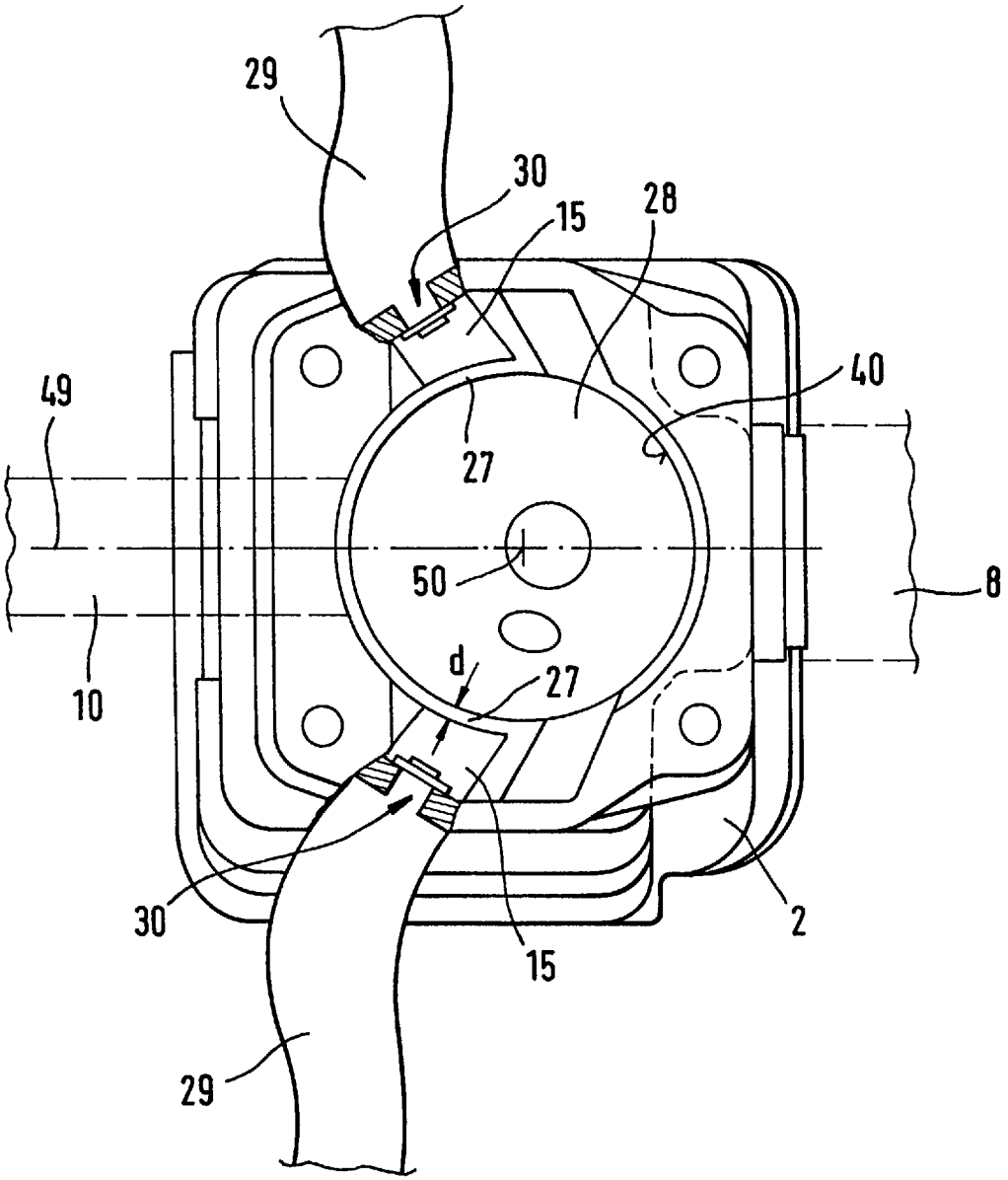

As shown in FIG. 2, two transfer channels 12 and 15 are arranged on each side of a symmetry plane 49 of the cylinder 2. The symmetry plane 49 includes the cylinder axis 50 and partitions the outlet 19 preferably approximately symmetrically. The number of transfer channels 12 and 15 are only exemplary and n-channels ($n \geqq 2$) are possible. Referred to the symmetry plane 49 of the cylinder 2, it is advantageous to provide an even number of outlet-near transfer channels 15 which are arranged symmetrically to the symmetry plane 49. Outlet-near channels 15 are those channels which are near the outlet window 19 of outlet channel 10. An advantageous number of channels is three and more and a four channel engine is characterized by a symmetrical configuration.

In the embodiment shown, the transfer channels 12 and 15 extend essentially parallel to the cylinder axis 50 in the cylinder wall 18 starting from the crankcase 4 and extending to the elevation of the combustion chamber 3. The transfer channel (12 or 15) can, however, be configured so as to have a helical shape as a departure from the embodiment shown or can extend in a bellied curve.

As shown in FIG. 1, the first, outlet-near transfer channel 15 is connected at the first end 21 to the combustion chamber 3 via a transfer window 25 lying in the cylinder wall 18; whereas, the second end 23 of this transfer channel 15 communicates with the crankcase 4 via an in-flow opening 35.

This outlet-near transfer channel 15 is configured closed along its axial length to the piston 5, that is, to the cylinder bore 28. As shown in FIG. 2, the wall 27 between the cylinder bore 28 and the transfer channel 15 has a thickness (d) of approximately 2 mm to 6.5 mm.

The outlet-near transfer channels 15 are arranged on both sides of the symmetry plane 49 and each transfer channel 15 is connected to an air channel 29 between its ends 21 and 23. The air channel 29 supplies essentially fuel-free gas, especially air. The air channels 29 are purposefully connected via a check valve 30 to the transfer channels 15. Each of the check valves 30 open into the transfer channel 15. The valve 30 can, however, also be provided as a valve window in the piston path 40 which is slot-controlled by the piston. If an underpressure is present in the crankcase 4, then the check valves 30 are pressure-controlled to their open state and the transfer channels 15 become filled over their entire volume with fuel-poor air and preferably fuel-free air. For this purpose, it is practical to arrange the check valves 30 at the elevation of the transfer window 25 so that as little as possible of dead space remains between the check valve 30 and the transfer window 25. This dead space is scavenged during the inflow of the fuel-free air so that essentially the entire volume of the overflow channel 15, which is provided between the transfer window 25 and the entry opening 35, is filled with fuel-poor air or fuel-free air. The inflow opening 35 of the transfer channel 15 is open to the crankcase 4 for every stroke position of the piston 5. For this reason, the check valve 30 opens already when the crankcase pressure changes from overpressure to underpressure. The sum of the constructive volumes of the outlet-near transfer channels 15 between the transfer windows 25 and the inflow openings 35 thereof corresponds approximately to 20% to 60% of the total volumetric air input of the engine 1 at rated rpm.

The outlet-remote transfer channels 12 open at one end 24 to the combustion chamber 3 via transfer windows 22 and are connected at the other end 26 to the crankcase 4 via an inflow opening 32.

The air/fuel mixture, which is needed for the operation of the engine, flows into the combustion chamber 3 exclusively via the inflow opening 32 from the crankcase 4 and the outlet-remote transfer channels 12 of which two are arranged in the embodiment shown. However, it can be sufficient to provide a single transfer channel 12 whose transfer window 22 can then advantageously lie in the wall region of the cylinder wall 18 lying opposite the outlet window 19.

In the embodiment shown, the outlet-remote transfer channels 12 lie symmetrical on both sides of the symmetry plane 49. The transfer windows 22 of these channels lie approximately at the elevation of the transfer windows 25 of the outlet-near transfer channels 15. It can be practical to arrange the transfer windows 25 of the outlet-near transfer channels 15 somewhat higher than the transfer windows 22 of the outlet-remote transfer channels 12 so that, for a downward traveling piston 5, the outlet-near transfer windows 25 are opened first and the outlet-remote transfer windows 22 are opened thereafter.

During operation of the engine, a total air quantity of approximately 30% to 70% of the total volumetric air input of the engine is supplied at rated rpm of the engine as component flows via the outlet-near transfer channels 15. Advantageously, approximately 35% to 45% of the volumetric air input is made available as a total air quantity via the transfer channels 15. Only small scavenging losses occur as to the mixture. The volumetric design of the outlet-near transfer channels 15 is provided in such a manner that the formed stratified charge in the combustion chamber 3 is maintained over approximately 65% to 95% (preferably, approximately 75%) of the duration of the scavenging operation. This means that the outlet window 19 is blocked off over a very long time span by the total quantity of air which flows in via the transfer channels 15 as component flows so that the air/fuel mixture entering into the combustion chamber via the outlet-remote channel 12 is hindered from escaping. In this way, the exhaust-gas quality is significantly improved while at the same time an excellent combustion of the mixture in the combustion chamber 3 is ensured which becomes manifest in a ready development of power of the engine.

It is understood that the foregoing description is that of the preferred embodiments of the invention and that various changes and modifications may be made thereto without departing from the spirit and scope of the invention as defined in the appended claims.

What is claimed is:

1. A two-stroke engine including a two-stroke engine in a portable handheld work apparatus, the two-stroke engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder:

a carburetor for supplying an air/fuel mixture and said carburetor having an intake channel;

an inlet channel connected to said intake channel and leading to said crankcase so as to permit the entire quantity of said air/fuel mixture to be drawn by suction via said crankcase;

said cylinder having a discharge outlet formed therein for conducting exhaust gases away from said combustion chamber;

an outlet-near transfer channel connecting said crankcase to said combustion chamber;

said outlet-near transfer channel having a first end defining a transfer window opening into said combustion chamber and a second end defining an inflow opening open to said crankcase;

an air channel opening into said transfer channel at approximately the elevation of said transfer window thereof for supplying an essentially fuel-free gas flow to said transfer channel;

an outlet-remote transfer channel connecting said crankcase to said combustion chamber;

said outlet-remote transfer channel having a first end defining a transfer window opening into said combustion chamber and a second end defining an inflow opening open to said crankcase;

a sum of the constructive volumes of said outlet-near transfer channel between said transfer window and said inflow opening being approximately 20% to 60% of the volumetric total air input of said engine at rated engine speed so that approximately 30% to 70% of the volumetric total air input of said engine to said combustion chamber at said rated engine speed is supplied via said outlet-near transfer channel and a stratified charge formed in said combustion chamber is maintained via said outlet-near transfer channel over a time of approximately 65% to 95% of the scavenging operation.

2. The two-stroke engine of claim 1, wherein said output-near transfer channel is closed to said piston.

3. The two-stroke engine of claim 2, wherein said cylinder wall has an inner wall surface along which said piston slides during the movement thereof; and, said cylinder having thickness (d) between said wall surface and said outlet-near transfer channel of approximately 2 mm to 6.5 mm.

4. The two-stroke engine of claim 1, wherein said cylinder defines a longitudinal axis and symmetry plane containing said longitudinal axis; and, said engine further comprising an even number of said outlet-near transfer channels referred to said symmetry plane.

5. The two-stroke engine of claim 1, wherein said outlet-remote transfer channel is open toward said piston.

6. The two-stroke engine of claim 1, further comprising a valve for connecting said air channel to said outlet-near transfer channel.

7. The two-stroke engine of claim 6, wherein said valve is a check valve opening into said outlet-near transfer channel.

8. A method for operating a two-stroke engine including a two-stroke engine in a portable handheld work apparatus, the two-stroke engine including: a cylinder having a cylinder wall; a piston mounted in said cylinder to undergo a reciprocating movement along a stroke path between top dead center and bottom dead center during operation of said engine; said cylinder and said piston conjointly delimiting a combustion chamber; a crankcase connected to said cylinder; a crankshaft rotatably mounted in said crankcase; a connecting rod connecting said piston to said crankshaft to permit said piston to drive said crankshaft as said piston reciprocates in said cylinder; a carburetor for supplying an air/fuel mixture and said carburetor having an intake channel; an inlet channel connected to said intake channel and leading to said crankcase so as to permit the entire quantity of said air/fuel mixture to be drawn by suction via said crankcase; said cylinder having a discharge outlet formed therein for conducting exhaust gases away from said combustion chamber; an outlet-near transfer channel connecting said crankcase to said combustion chamber; said outlet-near transfer channel having a first end defining a transfer window opening into said combustion chamber and a second end defining an inflow opening open to said crankcase; an air channel opening into said transfer channel at approximately the elevation of said transfer window thereof for supplying an essentially fuel-free gas flow to said transfer channel; an outlet-remote transfer channel connecting said crankcase to said combustion chamber; and, said outlet-remote transfer channel having a first end defining a transfer window opening into said combustion chamber and a second end defining an inflow opening open to said crankcase; and, said method comprising the step of: supplying approximately 30% to 70% of the volumetric total air input of said engine to said combustion chamber at rated engine speed (rpm) via said outlet-near transfer channel.

9. The method of claim 8, wherein approximately 35% to 45% of the volumetric total air input of said engine is supplied to said combustion chamber at rated engine speed (rpm) via said outlet-near transfer channel.

10. The method of claim 8, wherein a stratified charge formed in said combustion chamber is maintained via said oulet-near transfer channel over a time of approximately 65% to 95% of the scavenging operation.

11. The method of claim 10, wherein said stratified charge is maintained over a time of approximately 75% of said scavenging operation.

* * * * *